US006413197B2

(12) United States Patent
McKechnie et al.

(10) Patent No.: US 6,413,197 B2
(45) Date of Patent: Jul. 2, 2002

(54) TORSION BOARD

(75) Inventors: Alexander McKechnie, Coquitlam; Frantisek Ziak, Port Moody, both of (CA)

(73) Assignee: 563704 B.C. Ltd., British Columbia (CA)

( * ) Notice: Subject to any disclaimer, the term of this patent is extended or adjusted under 35 U.S.C. 154(b) by 0 days.

(21) Appl. No.: 09/175,922

(22) Filed: Oct. 20, 1998

(51) Int. Cl.[7] ..... A63B 23/08
(52) U.S. Cl. ..... 482/146; 482/147; 482/127
(58) Field of Search ..... 482/146, 147, 482/80, 127, 79

(56) References Cited

U.S. PATENT DOCUMENTS

| | | | | |
|---|---|---|---|---|
| 3,024,021 A | | 3/1962 | Coplin et al. | |
| 3,451,672 A | | 6/1969 | Kazdan | |
| 3,488,049 A | | 1/1970 | Sasser, Jr. | |
| 3,491,189 A | | 1/1970 | Scheuerer et al. | |
| 3,586,321 A | | 6/1971 | Gehrke et al. | |
| 3,604,726 A | | 9/1971 | Tracy | |
| 3,862,768 A | | 1/1975 | England | |
| 3,929,329 A | | 12/1975 | Rivera | |
| 3,961,787 A | | 6/1976 | Studebaker et al. | |
| 3,984,100 A | | 10/1976 | Firster | |
| 4,491,318 A | | 1/1985 | Francke | |
| 4,505,477 A | | 3/1985 | Wilkinson | |
| 4,601,469 A | | 7/1986 | Sasser, Jr. | |
| 4,759,542 A | | 7/1988 | Hudec | |
| 4,817,950 A | * | 4/1989 | Goo | 482/146 |
| 4,850,588 A | | 7/1989 | Desjardins et al. | |
| 4,905,994 A | | 3/1990 | Hartz | |
| 4,966,364 A | * | 10/1990 | Eggenberger | 482/146 |
| 5,002,272 A | | 3/1991 | Hofmeister | |
| 5,048,823 A | | 9/1991 | Bean | |
| 5,062,624 A | * | 11/1991 | Vaughan | 482/146 |
| 5,190,506 A | | 3/1993 | Zubik et al. | |
| 5,292,296 A | | 3/1994 | Davignon | |
| 5,310,395 A | * | 5/1994 | Ko | 482/146 |
| 5,399,140 A | | 3/1995 | Klippel | |
| 5,522,783 A | | 6/1996 | Gordon | |
| 5,536,226 A | | 7/1996 | Gordon | |
| 5,603,334 A | | 2/1997 | Sharp | |
| 5,611,524 A | | 3/1997 | Gordon | |
| 5,643,161 A | | 7/1997 | Gordon | |
| 5,667,462 A | | 9/1997 | Gordon | |
| 5,674,166 A | | 10/1997 | Gordon | |
| 5,683,337 A | | 11/1997 | Zetocha et al. | |
| 5,749,816 A | | 5/1998 | Froelich, Sr. et al. | |
| 5,810,703 A | | 9/1998 | Stack | |
| 5,820,096 A | | 10/1998 | Lynch et al. | |

FOREIGN PATENT DOCUMENTS

| | | |
|---|---|---|
| FR | 2 410 486 | 6/1979 |
| FR | 2 592 802 | 7/1987 |

* cited by examiner

*Primary Examiner*—Jerome Donnelly
(74) *Attorney, Agent, or Firm*—Fulwider Patton Lee & Utecht, LLP

(57) ABSTRACT

A torsion board comprising a platform for supporting a user, a ground contacting member for maintaining the torsion board generally in a fixed position and orientation with respect to a ground surface and a resilient interconnecting member mounted between the ground contacting member and the platform to permit pivoting of the platform about first, second and third orthogonal axes, said first axis being generally coincident with a gravitational axis along which gravitational forces act upon said user.

11 Claims, 5 Drawing Sheets

TORSION BOARD

BACKGROUND OF THE INVENTION

This invention relates generally to the field of sports and exercise equipment, and, in particular to a torsion exercise board for improving and developing the strength, coordination and balancing ability of an individual.

Developing a good sense of balance, proprioception and coordination is generally a matter of practice. Many popular sports activities require a user to develop a well developed sense of proprioception or body awareness, including balance, in order to become proficient. For example, sports such as cycling, skiing, snowboarding, skateboarding and the like all involve the use of equipment that requires the user to be able to accurately control their position on the equipment. Continuous shifting and adjustment of the user's weight and centre of gravity with respect to the equipment at appropriate times is vital to proper use of the equipment and full enjoyment of the sport.

In the normal course of growing up, a person must develop an advanced sense of balance and coordination in order to graduate from a baby's crawling movements to the common walking and running movements of a child or adult. However, once the walking and running movements are mastered, balance, proximity to objects, inertia and rhythm of motion needed for manoeuvring in the everyday world are taken for granted by most people. To a large extent, everyday play of a child develops and refines these skills and perceptions. Common toys and sporting equipment such as bicycles, skateboards and snowboards also allow a person to practice and refine their coordination, strength and balance, for recreation and sports and during rehabilitation following injury.

In order to concentrate on developing these skills, apparatus known as balance or balancing boards have been developed. Prior art boards and other relevant exercise equipment known to the applicant are described in the following patents:

U.S. Pat. No. 842,462 to Grafin
U.S. Pat. No. 3,451,672 to Kazdan
U.S. Pat. No. 3,488,049 to Sasser
U.S. Pat. No. 3,491,189 to Mutius
U.S. Pat. No. 3,586,321 to Gehrke
U.S. Pat. No. 3,862,768 to England
U.S. Pat. No. 3,961,787 to Studebaker
U.S. Pat. No. 4,491,318 to Francke
U.S. Pat. No. 4,505,477 to Wilkinson
U.S. Pat. No. 4,601,469 to Sasser
U.S. Pat. No. 4,759,542 to Hudec
U.S. Pat. No. 4,850,588 to Desjardins
U.S. Pat. No. 5,048,823 to Bean
U.S. Pat. No. 5,190,506 to Zubik et al.
U.S. Pat. No. 5,292,296 to Davignon
U.S. Pat. No. 5,399,140 to Klippels Many prior art boards involve a platform that is pivotable about a singe axis. While this arrangement is initially challenging for a beginner, with practice, it becomes relatively easy to master. Alternatively, other balancing board designs rely on a spherical or hemispherical pivot point that permits movement in all directions. Such a design requires a well developed sense of balance to use and it is therefore best suited to an advanced user. Unfortunately, for a beginner, a spherical or hemi-spherical pivot is frustrating to use as consistent balance is difficult to achieve.

A more demanding application involves physical therapy patients who may be unable to even achieve balance on such prior art boards, and thus be unable to benefit from exercise to the torso and foot and leg muscles and joints that might be available to less physically challenged users of such a board.

What is needed is an exercise board that permits pivoting about three, orthogonal axes, permitting both novice and experienced users to engage in a desired level of exercise involving resistance, torsion and recoil, at increasing levels of difficulty. The current invention addresses these needs.

BRIEF SUMMARY OF THE INVENTION

In accordance with one aspect of the invention, there is provided a torsion board comprising a platform for supporting a user, a ground contacting member for maintaining the torsion board generally in a fixed position and orientation with respect to a ground surface, and a resilient interconnecting member mounted between the ground contacting member and the platform. The resilient interconnecting member permits pivoting of the platform about first, second and third orthogonal axes, the first axis being generally coincident with a gravitational axis along which gravitational forces act upon the user.

Preferably, the resilient interconnecting member, the platform and the ground contacting member are dimensioned such that the platform contacts the ground contacting member during the rotation of the platform about the second and the third axis to limit the rotation to a predetermined amount.

Preferably, the resilient interconnecting member is formed from an elastically deformable material. It is preferred that the elastically deformable material is urethane having a hardness in the range of about 50–90 on the Shore Durometer A Scale.

Preferably, the resilient interconnecting member is generally cylindrical, the platform and the ground contacting member being affixed to opposite ends of the interconnecting member.

It is preferred that the resilient interconnecting member is formed with integral mounting flanges at opposite ends to receive fasteners for mounting the resilient interconnecting member to the platform and the ground contacting member.

The interconnecting member can be either a solid cylinder or have a hollow inner core. The shape of the hollow core can be selected to define an interconnecting member with walls of generally uniform thickness or of non-uniform thickness.

In another embodiment of the invention, it is preferred that the resilient interconnecting member comprises at least one coil spring.

The apparatus of the present invention provides a device that can be used for exercise and recreation. As well, the apparatus is useful as a physical therapy and rehabilitation device that permits controlled, varied flexing of body joints.

DETAILED DESCRIPTION OF THE INVENTION

BRIEF DESCRIPTION OF THE SEVERAL VIEWS OF THE DRAWING

In drawings which illustrate embodiments of the invention,

FIGS. 1 and 2:

Referring to FIGS. 1 and 2, a torsion board according to the first embodiment of the invention is shown generally at 10. The board includes a generally planar, elongated user platform 12 for supporting a user, a similar, generally planar ground platform 14 for supporting the torsion board 10 on a generally horizontal floor or ground surface 15 and a resilient interconnecting member 16. The ground platform 14 thus acts as a ground contacting member. The resilient interconnecting member is preferably affixed to the platforms with a plurality of bolts 17, nuts 18, and pressure plates 19. The resilient interconnecting member permits the user, when upon the user platform 12, to effect rotation of the user platform 12 about a first, generally vertical axis 22 relative to the ground platform 14, while maintaining the user platform 12 in a plane generally parallel to the ground 15 by balancing. The balancing being effected by minimizing pivoting of the user platform 12 about generally horizontal second and third axes 23 and 24. The first axis 22 is generally coincident with a gravitational axis along which gravitational forces act upon the user.

Figure 1:
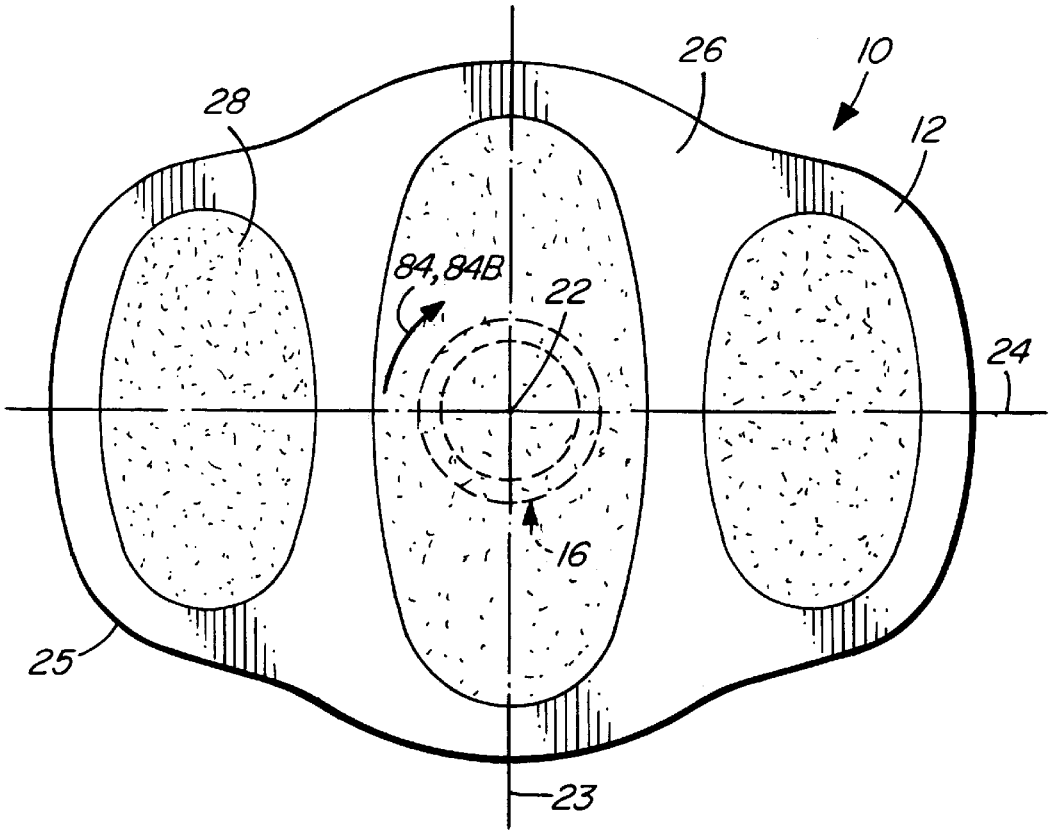
FIG. 1 is a plan view of a torsion board according to a first embodiment of the invention.

The user platform 12 and ground platform 14 are preferably formed of multi-ply hardwood material having a thickness of approximately 0.5 inches, each lying in a plane parallel to a plane defined by the second and third axes 23 and 24 and with each having a first dimension of approximately 32 inches as measured along an axis parallel to the second axis 23, a second dimension of approximately 20 inches as measured along an axis parallel to the third axis 24, and having a perimeter edge 25 having generally rounded corners. The above mentioned preferred dimensions and materials provide a user platform 12 that is rigid and durable. The user platform 12 has a user surface 26 with a plurality of friction surfaces 28 formed or affixed thereupon for providing non-slip contact regions for contacting the user's feet (not shown).

Figure 3:
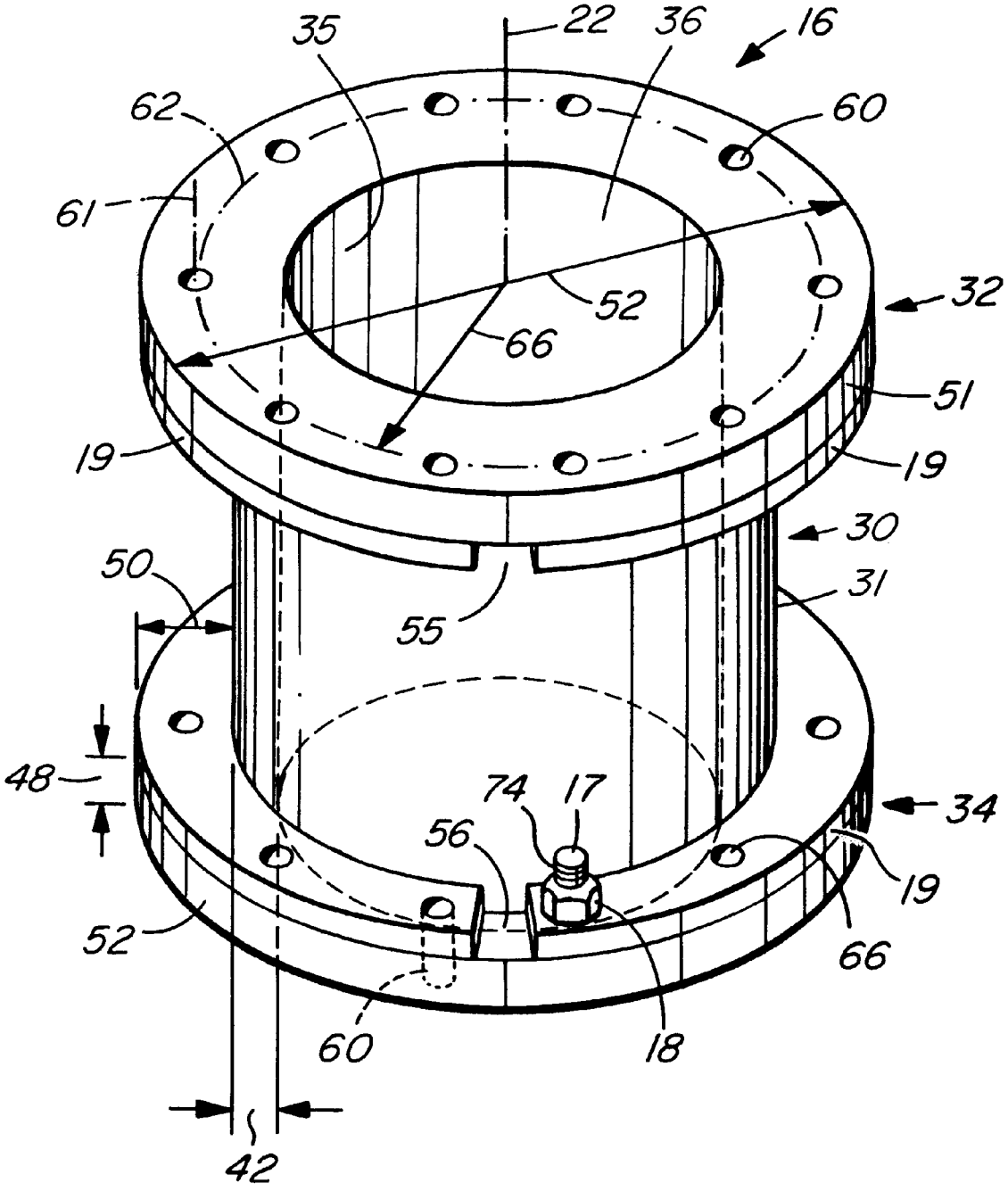
FIG. 3 is a perspective view of a resilient interconnecting member having a hollow core, according to the first embodiment of the invention.

FIG. 3:

Referring to FIG. 3, there is shown a preferred embodiment of the resilient interconnecting member 16. The member 16 is preferably formed from urethane material having a hardness of between 60 and 90 on the Shore Durometer A Scale, has a cylindrical body portion 30, with first and second identical annular flanges 32 and 34 formed at respective ends thereof. The interconnecting member can be injection moulded. The body portion 30 is dimensioned to be resiliently flexible to permit bending without collapsing, and to permit torsional deformation about the first, normally vertical axis 22. In the illustrated embodiment of FIG. 3, the interconnecting member 16 has a hollow core defined by central cavity 36 having a cylindrical inner surface 35. Outer surface 31, inner surface 35 of the body portion 30 and flanges 32 and 34 are coaxially aligned about the first axis 22. In the illustrated example, outer surface 31 has a diameter of approximately 3.0 inches, the inner surface 35 a diameter of approximately 1.0 inch, the body portion 30 thus having a uniform wall thickness of approximately 1.0 inches, corresponding to the distance 42 between the outer and inner surfaces, 31 and 35.

Figure 4:
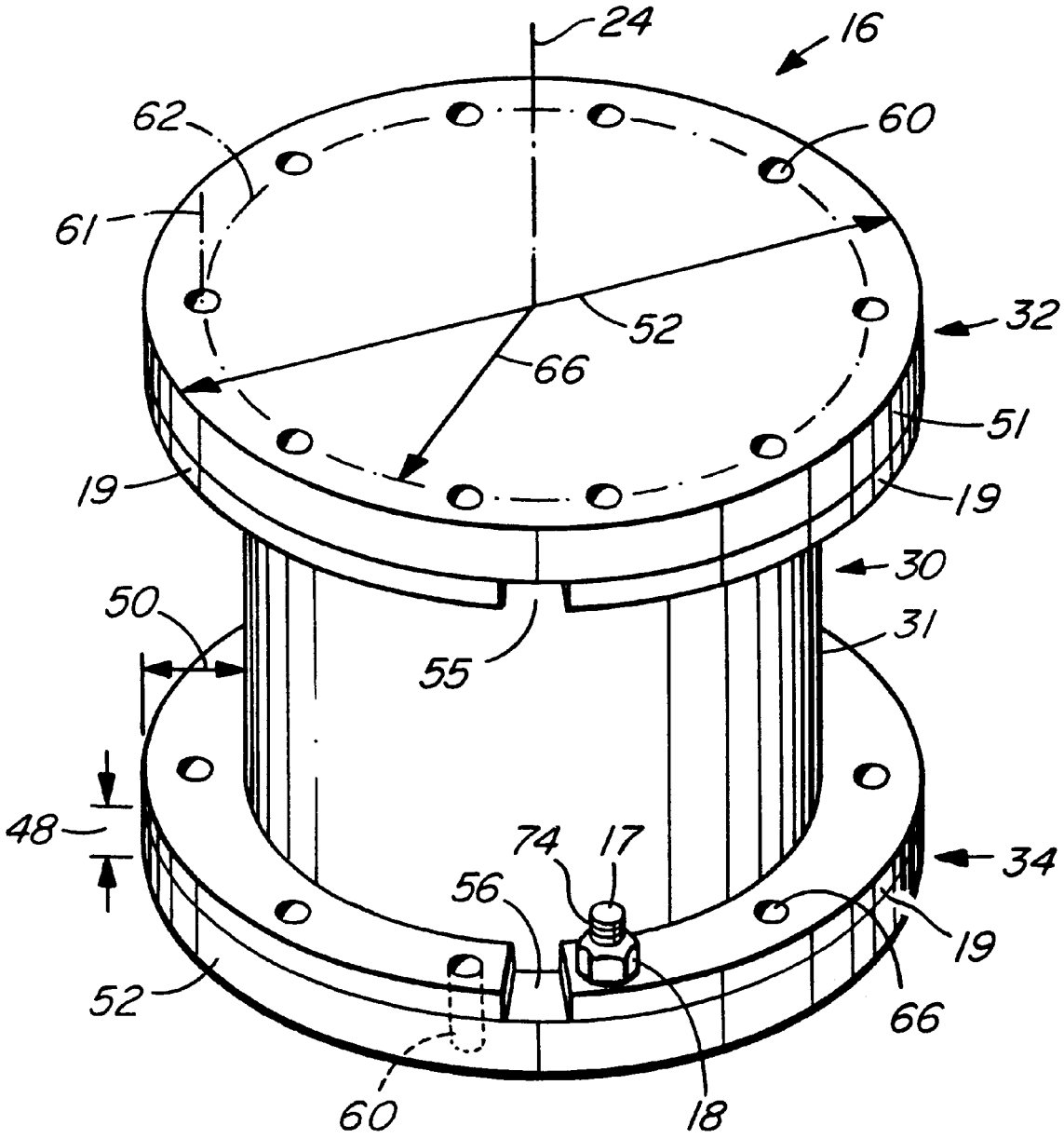
FIG. 4 is a perspective view of a resilient interconnecting member having a solid core, according to the first embodiment of the invention.

This arrangement with a central cavity 36 is intended to support larger and heavier users. The overall dimensions of the body portion 30 are selected to support the user while the central core is removed to permit relatively easy torsional deformation of the body portion 30 about the vertical axis 22, especially in cases where the body portion 30 has a larger diameter for providing greater stability for heavier users. It will be appreciated by those skilled in the art that resistance to bending of a structure similar to the resilient interconnecting member is determined largely by an outer diameter of such a member, while torsional resistance is generally proportional to cross sectional area of the member. The cavity is therefore sized to effect a desired reduction in torsional resistance with a somewhat lesser proportional reduction in bending resistance. For smaller or lighter users, the diameter of the cylindrical body portion 30 can be reduced and the resilient interconnecting member formed as a solid cylinder without the cavity 36. Such a body portion 30 is shown in FIG. 4, and has a resistance to bending moments and to torsional moments within a useful range.

It will also be appreciated that the resilient interconnecting member 16 may be formed to have a non-cylindrical shape, in order to provide different resistances to bending moments about the second and third axes 23 and 24, for example.

A particular advantage arising from the use of the resilient interconnecting member 16 of the present embodiment is the attainment of a generally stable dimension 29 separating the platforms over a wide range of user weights. The resilient interconnecting member 16, when formed of urethane having the hardness and dimensions disclosed in the present example, permits a user weighing from approximately 50 pounds to more than 200 pounds to effect full exercise benefits from use of the board. As disclosed elsewhere herein, exercising characteristics may be altered by changing dimensions of the resilient interconnecting member to suit users of differing weights and strengths.

Figure 2:
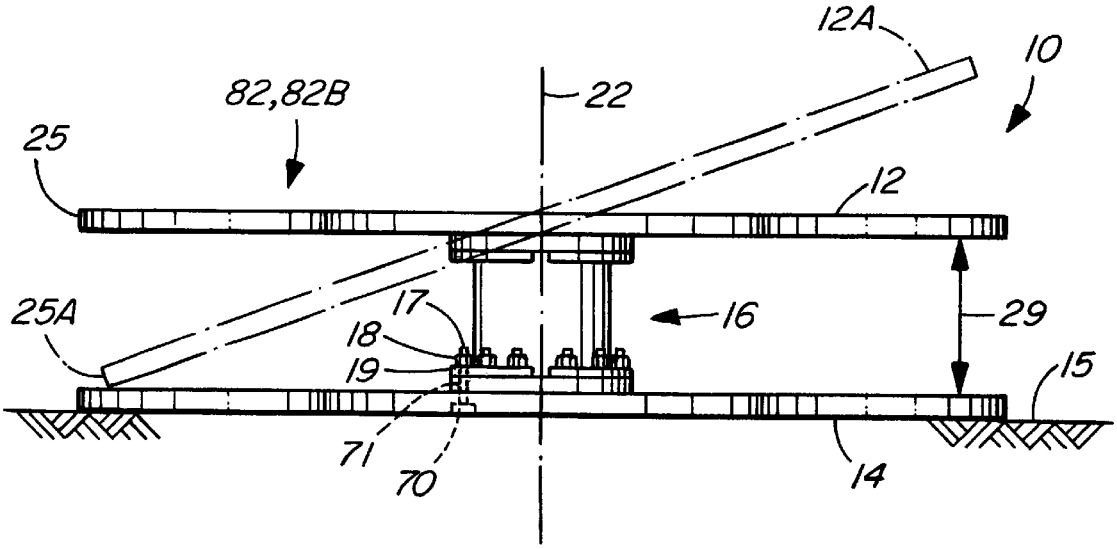
FIG. 2 is side elevation of the torsion board of FIG. 1.

In the interconnecting member 16 of FIG. 3, the flanges 32 and 34 each have a thickness 48 of approximately 0.5 inches and a flange width 49 of approximately 0.8 inches. The flanges 32 and 34 thus have similar cylindrical outer surfaces 50 and 51 each having a diameter 52 of approximately 4.6 inches. The resilient interconnecting member thus has parallel, annular end surfaces 53 and 54 each with outer diameter 52 of 4.6 inches and an inner diameter of 1.0 inches. The inner diameter in each case corresponds to the diameter of the inner surface 35. The end surfaces are separated by a distance of 3.5 inches, to define a rest separation, or stable dimension 29 between the user platform 12 and the ground platform 14, as shown in FIG. 2.

Flanges 32 and 34 also have parallel, annular proximal surfaces 55 and 56, respectively, with a plurality of bolt holes 60 drilled or formed therethrough, for receiving the fastening bolts 17.

The bolt holes 60 are formed along respective axes 61 parallel to first axis 22, the axes 61 being uniformly radially distributed about the flanges 32 and 34 and having centres upon a bolt circle 62 aligned concentrically with the outer and inner cylindrical surfaces 31 and 35. The bolt circle 62 has a diameter of approximately 3.8 inches, the holes 60 thus lying approximately midway across the proximal annular surfaces 55 and 56, between the outer surface 31 and the outer flange surfaces 50 and 51.

Four semi-annular pressure plates 19 are formed from semi-rigid material such as ¼ inch thick plywood, each having an inner annular radius slightly greater than 1.5 inches and an outer annular radius of approximately 2.3 inches, and each spanning an arc of slightly less than 180 degrees. Two such pressure plates 19 placed in opposing fashion upon either proximal surface 55 or 56 form a two-part, generally annular ring thereupon.

Each pressure plate 19 has a plurality of plate holes 66, the holes being formed about the pressure plates 19 such that when the pressure plates 19 are placed upon proximal surfaces 55 and 56, plate holes 66 are aligned concentrically with corresponding bolt holes 60. Plate holes 66 each have a diameter equal to that of the bolt holes 60.

Returning to FIG. 1, the user platform 12 and the ground platform 14 each have a plurality of corresponding platform holes 70 and concentric recesses formed therein. The platform holes are distributed on a circle about the first axis 22 at locations corresponding to bolt holes 60 such that the plurality of bolts 17 may be inserted through the corresponding holes 70 to protrude through the bolt holes 60 in the flanges 32 and 34. Each concentric recess has a diameter and depth such that when the bolts 17 are fully inserted into the holes 70, the head portion (not shown) of each bolt 17 lies completely within the recess corresponding recess 71. A conventional flat washer (not shown) may be placed about the bolt prior to insertion through the hole 70, the recess 71 being dimensioned such that both the washer and the headed portion (not shown) of the bolts 17 are enclosed therein.

Referring now to FIGS. 2 and 3, each bolt 17 has a threaded portion 74 with a length of approximately 1.5 inches, being slightly more than necessary to threadedly engage the corresponding nut 18 thereupon, when the bolt threaded portion 74 is fully extended through either the user platform 12 or the ground platform 14, and the corresponding flange 32 or 34 as well as the support plate 19.

Recesses 71 in the ground platform 14 are formed on the surface of the ground platform 14 adjacent the floor or ground surface 15.

With the bolts 17 extending through corresponding holes in the user platform 12, the ground platform 14, the first flange 32, the second flange 34 and corresponding pressure plates 19, a nut 18 is threadedly engaged with each bolt 17 and tightened thereupon.

With the nuts 18 thus tightened, the flanges 32 and 34 are gripped securely between respective pressure plates 19 and the user platform 12 and ground platform 14 the pressure plates 19 functioning to generally uniformly distribute gripping forces about each flange.

Operation

The torsion board of the present invention can be used in several different modes of operation.

A first mode of operation promotes the balancing ability of the user.

Referring to FIG. 1, the user exercises by placing his or her feet upon friction surfaces 28, with the user's weight being distributed uniformly about the first axis 22, such that no net bending moment such as shown at 82 in FIG. 2 is applied by the user platform 12 to the resilient interconnecting member 16. The user shifts his or her weight relative to the first axis 22 to attempt to maintain the user platform 12 in a plane parallel to the ground surface 15, as shown in closed outline 12 in FIG. 2. If the user's position shifts slightly so that gravitational forces acting on the user have a net force component not coincident with the first axis 22, a bending moment 82 as shown in FIG. 2 is applied by the user platform 12 to the resilient interconnecting member 16, and the user platform 12 rotates about the second and third axes 23 and 24 to a tilted position as shown in broken outline at 12A in FIG. 2. The user may return the user platform 12 to a desired orientation as shown in closed outlined 12 in FIG. 2, by again slightly shifting his or her body to reduce the bending moment 82, it being desirable that users become proficient in making such adjustments.

Rotation of the user platform 12 about the second and third axes 23 and 24 in response to the bending moment 82 is limited to an amount determined by dimensions of the user platform 12, the ground platform 14 and the resilient interconnecting member 16. A portion of the perimeter edge 25 limits such motion when the edge 25 is brought thereby into contact with the ground platform 14 or possibly the ground surface 15 as shown in broken outline at 25A in FIG. 2. Expressed differently, the resilient interconnecting member 16, the user platform 12 and the ground platform 14 are dimensioned such that the user platform 12 contacts the ground platform 14 during rotation of the user platform 12 about the second and third axes 23 and 24 to limit the rotation about the second and third axes 23 and 24 to a predetermined amount.

Continued practice by the user, including experimentation by changing foot placement on the user platform 12 at greater or lesser distances from the first axis 22, will permit the user to undertake pivoting motion to exercise the user's torso and shoulders.

Pivoting motion is attained by rotating the user's shoulders, pelvis girdle and legs relative to each other, thus generating a torsion moment 84 as shown in FIG. 1 causing the user platform 12 to rotate about the first axis 22 relative to the ground platform 14. The resilient interconnecting member 16 thus behaves as a torsion member, with the body portion 30 generating a torque urging the first flange 32 to rotate in a direction opposite to that of torsion moment 84 relative to the ground platform 14 and the second flange 34.

The moment 84 generated by the user's partial body rotation, being transient, is eventually overcome by torsion forces applied by the resilient interconnecting member, and the user platform 12 is rotated in a direction opposite that imparted by the user's body rotation, thus restoring the user platform 12 to a position where second and third axes 23 and 24 are again aligned with the corresponding axis of the ground platform 14, with rotation probably continuing past a point of such coincidence. The user may, through repeated and timely rotational shifts in his or her upper body, cause the user platform 12 and the user's feet and lower body portion to rotationally oscillate relative to the user's upper body portion at a rate and through an arc dependent upon the user's weight, distribution thereof about the user platform 12, and the rotational moment applied by the user.

The user's body, in order to sustain such motion over a number of oscillations, must also be maintained at a position relative to the first axis 22 such that the bending moment 82 does not cause the user platform 12 to tilt to a position where it is brought into contact with either the ground platform 14 or the supporting ground surface 15.

It will be appreciated that considerable practice on the part of the user will be necessary before the user can maintain his or her balance upon the board while sustaining rotational oscillation, and that while initial practice sessions will likely take place with the user's feet widely spaced upon the user platform 12, use of the torsion board can be made more challenging by changing foot placement and orientation, and by increasing body motion to increase platform rotation about the first axis 22.

It will also be appreciated that exercises such as step aerobics can be extended to include torsion boards incorporating the present invention. Such exercises involve rotation of the user's body with feet resting upon a fixed surface, for exercising knee, foot and other joints. The torsion board operates about three orthogonal axes, allowing the user to exercise joints through a broader variety of ranges of motion, while reducing much of the repetitive nature of step aerobic exercises. Traditional fixed surfaces require the user to balance on the ball of the foot, and to slidably rotate the foot upon the surface, which can result in either too little or too much torsional force being applied to leg and foot joints. An appropriately dimensioned torsion board of the present invention, used in place of the fixed surface, provides a predetermined resistance to rotation, and can thus provide a controlled and varied degrees of motion in the user's joints, and allow the muscles to function in variable degrees of stretch, with the user's foot firmly and flatly placed on the torsion board.

Alternatives

It will be appreciated by one skilled in the art that a resilient connecting member including a metallic coil spring having appropriate dimensions and being suitably affixed to the platforms 12 and 14 could be substituted for the urethane interconnecting member 16 disclosed herein. In a description of a second embodiment that follows, reference numbers having a suffix "B" are associated with apparatus identical to apparatus shown in FIGS. 1, 2 and 3 having corresponding reference numbers without the suffix.

Figure 5:
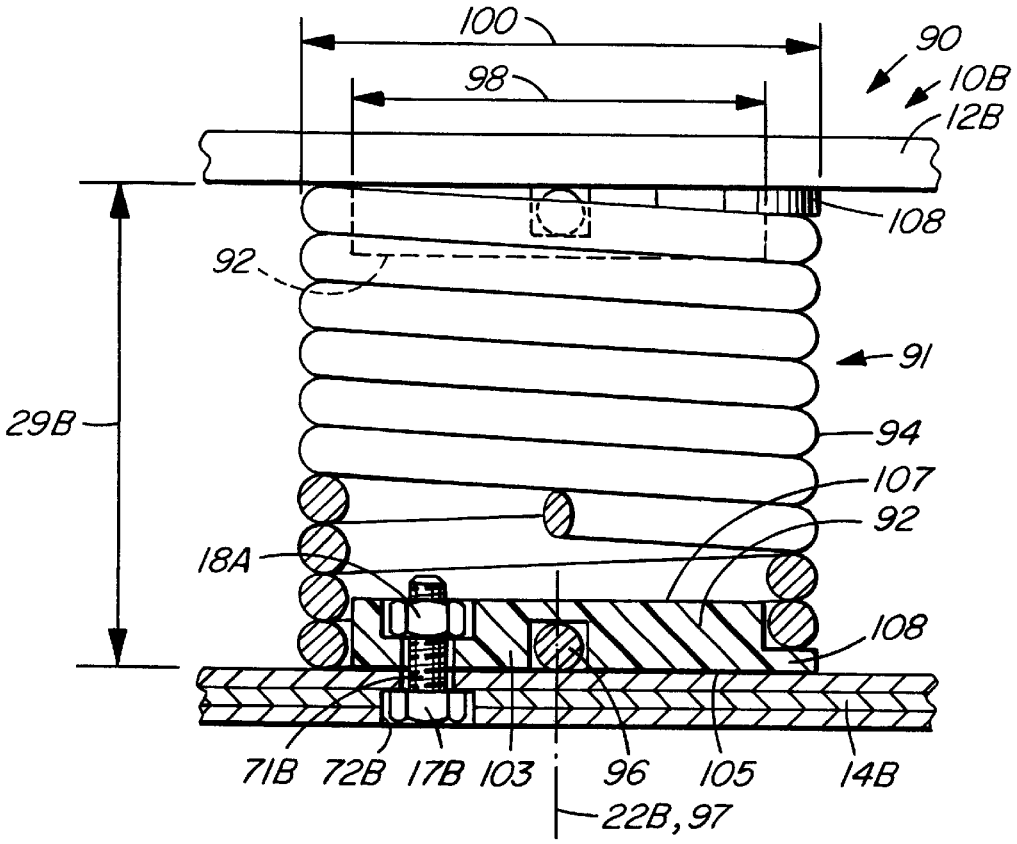
FIG. 5 is a side elevation of a resilient interconnecting member according to a second embodiment of the invention.
Figure 6:
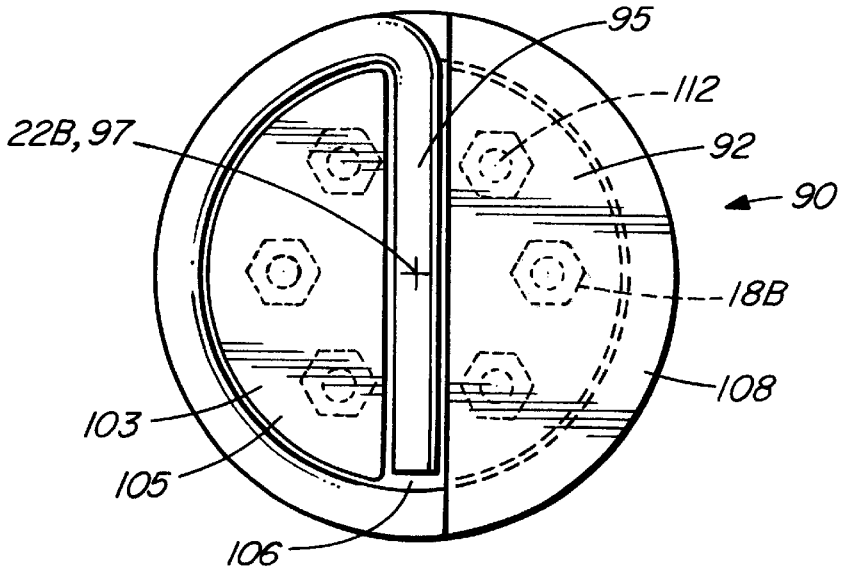
FIG. 6 is a plan view of the apparatus of FIG. 5.

FIGS. 5 and 6

Referring to FIGS. 5 and 6, a second embodiment of the invention is shown generally at 90. A coil spring 91 acts as a resilient interconnecting member and is affixed to the user platform 12 and the ground platform 14 with first and second clamping inserts 92 and a plurality of bolts 17B and nuts 18B. Coil spring 91 has a generally cylindrical shape and comprises a plurality of helical coils 94 and first and second end portions 95 and 96 formed across the ends of the spring 91, the end portions lying in a plane generally perpendicular to, and intersecting, the spring longitudinal axis 97. The spring 91 has an inside diameter 98 of approximately 5 inches and an outside diameter 100 of approximately 6 inches, the spring 91 being formed from a cylindrical steel rod having a diameter slightly less than 0.5 inches.

FIG. 7

Figure 7:
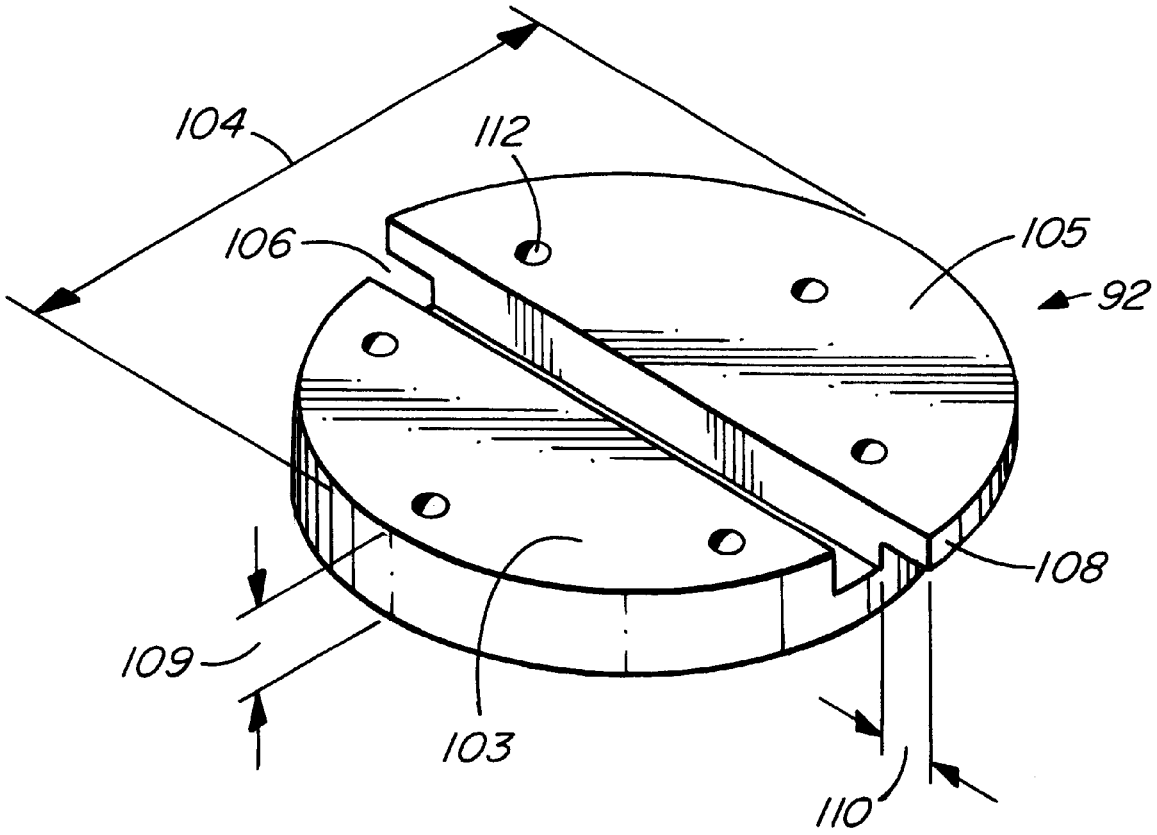
FIG. 7 is a perspective view of a clamping insert according to the second embodiment of the invention.

Referring to FIG. 7, the clamping insert 92 has a disc shaped body 103 with a diameter 104 approximately equal to spring inside diameter 98, for snugly engaging one or more coils 94. The insert 92 has a proximal surface 105 with a central slot 106 formed therein, a distal end surface 107, and a semi-annular lip 108 extending toward the proximal end surface 105 from the distal end surface 107, and outward from the body portion 103. The slot 106 is dimensioned to snugly receive the end portion 95 of the spring 91 therewithin. The insert 92 has a height 109 of approximately 0.75 inches, corresponding to a distance occupied by approximately 1½ coils 94 of the spring 91. The lip 108 has a width 110 of approximately 0.5 inches, the semi-annular lip 108 thus having an outside diameter approximately equal the outside diameter 100 of the spring 91. The inserts 92 are dimensioned to be received within the spring 91 with the end portions 95 snugly contained within respective recesses 106, and the bodies 103 generally enclosed within the spring with the lips 108 bearing against a portion of the coils 94 at the ends of the spring 91, such that the spring and the distal surfaces 107 of the insert 92 together form a body having a generally right cylindrical shape.

Referring back to FIG. 6, nuts 18B are embedded within the insert at locations corresponding to holes 71B drilled in the user platform 12 and the ground platform 14. Holes 112 are formed in the insert 92 such that bolts 17B may be inserted therethrough and threadedly engage nuts 18*a*. Recesses 72B correspond to recesses 72 discussed in connection with the first embodiment of the invention, bolts 17*a*, nuts 18B and inserts 92 functioning to affix the coil spring 91 to the user platform 12 into the ground platform 14 such that the user platform 12 is maintained in a plane parallel to that of the ground platform 14, and with the resilient interconnecting member, in this case the spring 91, aligned upon axis 22B.

It will be appreciated that in the second embodiment of the invention, the coil spring 91 and inserts 92 function as a support column able to support a user upon the user platform 12 such that the user platform 12 is maintained apart from the ground platform 14 by distance 29*b*, when the user's weight is distributed uniformly about axis 22B.

Referring also to FIG. 2, it will be appreciated that a user upon the user platform 12 in a torsion board 10B comprising a coil spring resilient member, the user may shift his or her weight such that a moment 82B is applied to the user platform 12 such that the coil spring 91 is bent along axis 22B, such bending being limited by contact between the user platform 12 and the ground platform 14 in a manner similar to that discussed in connection with FIG. 2.

Referring also to FIG. 1, it will further be appreciated that a user applying a rotational moment 84B to the user platform 12 will cause the spring 91 to undergo greater or lesser coiling, the spring applying an opposing moment, resistance of the spring 91 to moment 82B and moment 84B being generally proportional to bulk modulus and modulus of elasticity characteristics, respectively, of the material from which the spring 91 is formed.

It will be appreciated that while the resiliency characteristics of neoprene interconnecting member 16 and of the coil spring interconnecting member 91 will differ somewhat in their respective responses to moments 82 and 82B and moments 84 and 84B, a torsion board 10B using a coil spring 91 may used to generally deliver the same benefits as available in the first embodiment.

It will be appreciated that a plurality of resilient interconnecting members may be substituted for the single member urethane cylinder or coil spring disclosed, to provide greater or lesser resistance to bending moments 82 and 82B, and to torsion moments 84 and 84B.

Thus, two specific embodiments of a torsion board are provided that allow a user to practice and improve balance, during different degrees of body rotation and position shifts, including mid-body exercise motion, for enhancing performance while participating in sports such as skiing, basketball and others.

While specific embodiments of the invention have been described and illustrated, such embodiments should be considered illustrative of the invention only and not as limiting the invention as construed in accordance with the accompanying claims.

What is claimed is:

1. A torsion board comprising:

a platform for supporting a user;

a ground contacting member for maintaining the torsion board generally in a fixed position and orientation with respect to a ground surface;

a generally cylindical, resilient interconnecting member between the ground contacting member and the platform having opposed ends formed with integral mounting flanges to receive a plurality of fasteners for fixedly mounting the interconnecting member of the ground contacting member and the platform to permit pivoting the platform about first, second and third orthogonal axes due to twisting or bending of the resilient interconnecting member, said first axis being generally coincident with a gravitational axis along which gravitational forces act upon said user.

2. A torsion board as claimed in claim 1 wherein said resilient interconnecting member, said platform and said ground contacting member are dimensioned such that said platform contacts said ground contacting member during said rotation of said platform about said second and said third axis to limit said rotation thereabout to a predetermined amount.

3. A torsion board as claimed in claim 1 wherein said resilient interconnecting member is formed from an elastically deformable material.

4. A torsion board as claimed in claim 3 in which the elastically deformable material is urethane having a hardness in the range of about 50-90 on the Shore Durometer A Scale.

5. A torsion board as claimed in claim 1 wherein said interconnecting member has a hollow inner core defining an annular member with walls of generally uniform thickness.

6. A torsion board as claimed in claim 1 wherein said interconnecting member has a hollow inner core defining an annular member with walls of non-uniform thickness.

7. A torsion board as claimed in claim 1 wherein said interconnecting member is solid.

8. A torsion board as claimed in claim 3 wherein said resilient interconnecting member includes at least one coil spring.

9. A torsion board as claimed in claim 8 wherein said at least one coil spring includes a plurality of generally equal diameter coils coaxially aligned with said first axis.

10. A torsion board as claimed in claim 9 wherein said at least one coil spring is dimensioned to be substantially fully compressed when said user is balanced upon said platform.

11. A torsion board as claimed in claim 10 wherein said at least one coil spring is dimensioned to maintain said platform apart from said ground contacting member by a predetermined amount when said user is balanced upon said platform.

* * * * *

UNITED STATES PATENT AND TRADEMARK OFFICE

CERTIFICATE OF CORRECTION

PATENT NO. : 6,413,197 B2 
DATED : July 2, 2002
INVENTOR(S) : Alexander McKechnie et al.

It is certified that error appears in the above-identified patent and that said Letters Patent is hereby corrected as shown below:

Title page,
Item [56], References Cited, FOREIGN PATENT DOCUMENTS, add the following:
-- GB 1 372 342 10/1974 --.

Signed and Sealed this

Fifteenth Day of October, 2002

*Attest:*

*Attesting Officer*

JAMES E. ROGAN
*Director of the United States Patent and Trademark Office*